United States Patent [19]

Wittner

[11] 3,960,696

[45] June 1, 1976

[54] ALUMINUM ELECTROLYSIS FURNACE

[75] Inventor: Hubert Wittner, Ludwigshafen (Rhine), Germany

[73] Assignee: Gebr. Giulini GmbH, Ludwigshafen (Rhine), Germany

[22] Filed: June 18, 1974

[21] Appl. No.: 480,926

[52] U.S. Cl. ..... 204/245; 204/67; 204/243 R

[51] Int. Cl.[2] ..... C25C 3/08; C25C 7/00

[58] Field of Search ... 204/243 R, 243 M, 244–247, 204/67, 275

[56] References Cited

UNITED STATES PATENTS

| | | | |
|---|---|---|---|
| 1,369,578 | 2/1921 | Trembour | 204/243 R |
| 1,769,298 | 7/1930 | Lauber | 204/243 R |
| 3,321,392 | 5/1967 | McMinn et al. | 204/243 R |
| 3,509,030 | 4/1970 | Gooding | 204/67 |
| 3,773,643 | 11/1973 | Russell et al. | 204/243 R |

FOREIGN PATENTS OR APPLICATIONS

| | | | |
|---|---|---|---|
| 388,633 | 6/1965 | Switzerland | 204/243 R |
| 271,026 | 8/1970 | U.S.S.R. | 204/243 R |

*Primary Examiner*—G. L. Kaplan
*Attorney, Agent, or Firm*—Spencer & Kaye

[57] ABSTRACT

In an aluminum electrolysis furnace provided with an anode structure located above a cathode forming part of the bottom of the furnace chamber, whereby direct electric current between the anode and the cathode causes aluminum to be obtained from aluminum oxide, a portion of the surface of the cathode facing the anode is covered with an electrically nonconductive material to create an electric current distribution which tends to improve the heat distribution within the furnace chamber.

8 Claims, 2 Drawing Figures

ALUMINUM ELECTROLYSIS FURNACE

BACKGROUND OF THE INVENTION

The present invention relates to large-scale electrolysis furnaces of the type providing a heating current between a cathode and an anode.

The cathode of a conventional large-scale electrolysis furnace is known to consist of carbon blocks, all of the same electrical conductance, in which steel bars are embedded to conduct the electric current. The electrolysis current path extends from the anode, vertically through the electrolyte and, when passing into the molten aluminum layer covering the carbon cathode blocks, which layer has an electrical conductivity 2300 times better than the carbon blocks, is directed toward the side walls of the electrolysis cell, i.e. toward the point where the steel cathode bars emerge from the cathode blocks. As a result, the bottom of the electrolysis furnace directly underlying the anodes in the area of the longitudinal center axis of the furnace becomes electrically and thermally understressed whereas the region along the longitudinal sides of the furnace becomes electrically and thermally overstressed.

It is also known that aluminum oxide can be introduced into the electrolysis furnace along the longitudinal sides of the furnace as well as in the region of the longitudinal center axis. For an electrolysis furnace which is fed at the longitudinal sides, the thermal overstress in the region of the longitudinal sides of the furnace is compensated by the heat of solution absorbed by the dissolution of the aluminum oxide in the cryolite so that a temperature drop results from the center of the furnace to the longitudinal sides of the furnace. At the longitudinal sides of the furnace there thus is formed a crust of hardened electrolyte which protects the carbon side walls of the furnace against the corrosive molten electrolyte. The thickness of the crust depends on various parameters, for example the quantity of aluminum oxide introduced per unit time. Without the above-mentioned protective layer, the electrolysis operation cannot be continued for extended periods of time.

In electrolysis furnaces in which the aluminum oxide charges are fed in along the center longitudinal axis of the furnace this increase in the cathode current density has its full effect along the longitudinal sides of the furnace; in contradistinction to the above-mentioned feeding of the aluminum oxide charge at the longitudinal sides, this type of charging produces a temperature drop from the longitudinal sides of the furnace to the center axis of the furnace.

This means that a furnace which is charged with aluminum oxide along its center will have a higher temperature in the region of the longitudinal sides of the furnace than in the region of the center axis of the furnace since there is no absorption of heat of solution along the sides. A protective layer of hardened electrolyte can thus not form, or can form only with difficulty, along the longitudinal sides of the electrolysis furnace, which sides are of carbon.

SUMMARY OF THE INVENTION

It is therefore an object of the present invention to influence the cathode current distribution in aluminum electrolysis furnaces in order to overcome the above-described difficulties and to permit suitable formation of the electrolyte crust which is required for erosion protection.

This and other objects according to the invention are achieved by partially covering the cathode surface which faces the anode with a layer of an electrically nonconductive material. The electrically nonconductive material must be of a type that is not adversely affected by the molten aluminum with which it comes in contact and must be adapted to the thermal expansion behavior of the carbon cathode blocks. Ceramic stones or compressed masses of silicon carbide, magnesite, corundum, or silicon carbide and silican nitride, for example, have been found suitable for this purpose. The nonconductive material may be inserted or pressed into recesses provided in the cathode surface for this purpose.

DESCRIPTION OF THE PREFERRED EMBODIMENTS

Figure 1:
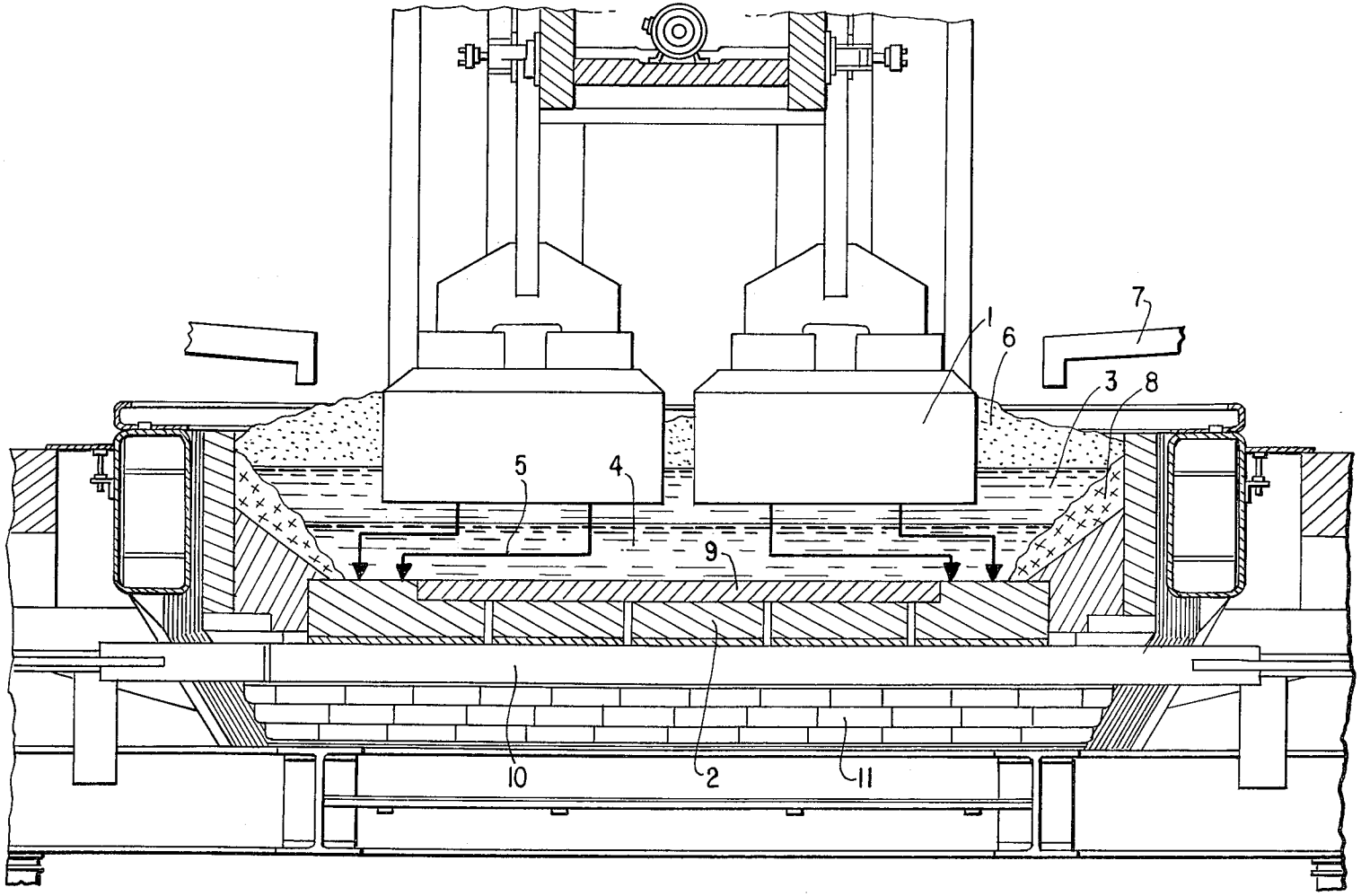
FIGS. 1 and 2 are cross-sectional elevational side views of an electrolysis furnace provided with two embodiments of the invention.

In the embodiment of the invention shown in FIG. 1, the aluminum oxide charge is introduced into the furnace through the feed pipes 7 along the longitudinal sides of the furnace. Below the continuously or intermittently introduced aluminum oxide covering layer 6 lies the molten electrolyte 3 and therebelow the molten aluminum layer 4. The anodes 1 are immersed in the electrolyte 3, and the cathode 2 is located above the steel bars 10 which rest on the floor 11 of the furnace.

In accordance with the invention, the cathode 2 is covered with an electrically nonconductive layer 9 which causes the entire electrolysis current to be laterally deflected as shown by arrows 5 and the heat thus released is consumed by the dissolution and reduction of the fed-in aluminum oxide to such an extent that the desired protective layer 8 of hardened electrolyte can form on the sides to a thickness which is adapted to the thermal equilibrium within the electrolysis furnace.

Figure 2:
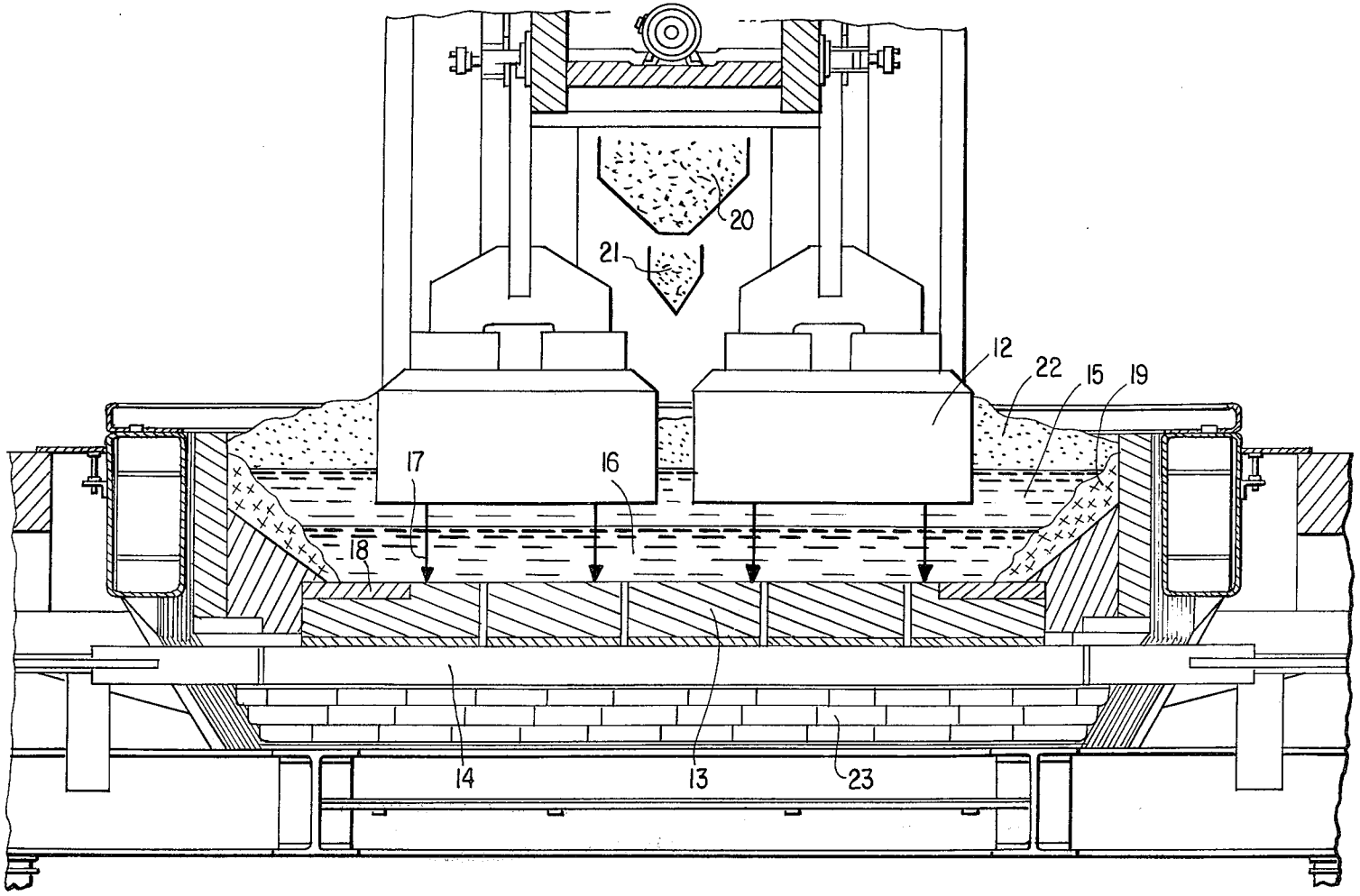

FIG. 2 is a cross-sectional view of an electrolysis furnace arranged for delivery of the aluminum oxide charge in the region of the longitudinal center axis of the furnace. With such a manner of charging, the longitudinal sides of the furnace must be unstressed electrically and thus thermally in favor of the cathode surface disposed below the anode. An aluminum oxide hopper 20 is located between anodes 12 and the aluminum oxide is continuously or intermittently charged into the electrolysis furnace from this hopper and forms the cover layer 22. A mass of electrolyte 15 and layer of molten aluminum 16 are disposed between cover layer 22 and cathode 13. Cathode 13 is located above steel bars 14 supported on furnace floor 23. A loading chisel 21 is provided to break up the electrolyte crust.

According to the invention, the cathode is provided with insulation portions 18 located to cause the electrolyte current to flow vertically through the carbon cathode blocks 13. This promotes establishment, in the furnace, of a temperature drop extending from the center of the furnace to the longitudinal sides thereof which is favorable for the electrolysis process. The heat formed by the passage of current only under the anode surface is continuously consumed by the aluminum oxide in the form of decomposition and solution heat and the temperature at the longitudinal sides of the furnace will be so low that a protective layer 19 of hardened electrolyte is formed thereon, the thickness of which is determined by the thermal equilibrium conditions within the electrolysis furnace.

The combination of electrically conductive carbon blocks and electrically nonconductive ceramic improves the electrolysis operation in the electrolysis of aluminum and makes it more operationally dependable and must therefore be considered to constitute a significant technical advance.

In an electrolysis furnace provided with the cathode 2 of FIG. 1 and loaded with a current of 110,000 amperes, the cathode surface which faces the anode is covered with a layer of silicon nitride. Silicon nitride is a material which is resistant to molten aluminium and sold by CARBORRUNDUM Co. Niagara Falls, USA under the trademark Refrax.

Above the electrolysis furnace and extending down into the molten electrolyte are 24 pre-baked carbon anodes. The dimensions of the electrically nonconductive layers on the cathode are 672 cm × 215 cm (= 144,000 $cm^2$), the dimensions of active cathode 750 cm × 325 cm (= 244,000 $cm^2$) and the dimensions of the active anodes are likewise 672 cm × 215 cm.

In such a furnace which is arranged to receive charges of aluminium oxide along the longitudinal sides thereof the electrolysis current path is directed toward the point where the steel cathode bars emerge from the cathode blocks, this means the electrolysis current entering the molten aluminium is deflected for an angle of 90° and the current in the molten metal flows in parallel direction to the lower sides of the anodes. The heat formed by the passage of current is developed in the region between the longitudinal sides of the furnace and the anodes, this is exactly in the region in which the heat is needed for solution of aluminium oxide.

Supposing that the furnace (110,000 amperes) is arranged for delivery of the aluminium oxide charge in the region of the longitudinal center axis as in FIG. 2 shown, dimensions of the electrically nonconductive layers on the cathode are 2 × (50 cm × 750 cm) along the longitudinal sides of the furnace and 2 × (40 cm × 390 cm) on the facade of the furnace. The total nonconductive surface is therefore 101,000 $cm^2$. In this case the surface of the cathode opposite to the anode is electrically active and the electrolyte current flows vertically through the layer of molten aluminium to the carbon cathode blocks 13. The result of this arrangement is that the heat is formed in the region between the anodes where heats of solution is needed.

In either case the formation of the electrolyte crusts which are required for erosion protection, takes place. The advantage of the invention — namely the location of heat formation — is evident.

It will be understood that the above description of the present invention is susceptible to various modifications, changes and adaptations and the same are intended to be comprehended within the meaning and range of equivalents of the appended claims.

I claim:

1. In an aluminum electrolysis furnace arranged to be filled with a mass of electrolyte and having a plurality of anodes each presenting a surface through which current flows and a cathode presenting a surface through which current flows, which faces the anode surfaces, and which is located to underlie the region to be occupied by the electrolyte, with at least part of the cathode surface being coextensive with the anode surfaces, the cathode being composed of a plurality of carbon blocks all having the same electrical conductance, the improvement comprising a layer of an electrically nonconductive material covering a portion of the surface of said cathode which faces said anode surfaces, said layer being located to underlie the region to be occupied by the electrolyte and being at least partially coextensive with said anode surfaces and being disposed for creating a current distribution between said anode and cathode which promotes formation of a hardened electrolyte layer at the sides of said furnace.

2. Electrolysis furnace as defined in claim 1 wherein said furnace is arranged to receive charges of aluminum oxide along the longitudinal sides thereof and said layer of electrically nonconductive material covers a portion of said cathode surface directly opposite said anodes in the longitudinal center region of said furnace.

3. Electrolysis furnace as defined in claim 1 wherein said furnace is arranged to receive charges of aluminum oxide along the longitudinal center axis thereof and said layer of electrically nonconductive material covers portions of the edge regions of said cathode.

4. Electrolysis furnace as defined in claim 3 wherein said anodes are opposite only the central region of said cathode and portions of said layer of nonconductive material cover the portions of said cathode outside such central region.

5. Electrolysis furnace as defined in claim 1 wherein said layer is of a ceramic stone material having a coefficient of thermal expansion corresponding to the coefficient of thermal expansion of the material of said cathode.

6. Electrolysis furnace as defined in claim 1 wherein said layer comprises a pressed mass of a material whose coefficient of thermal expansion corresponds to the coefficient of thermal expansion of said cathode.

7. Electrolysis furnace as defined in claim 6 wherein said layer is constituted by silicon carbide, magnesite, or corundum.

8. In an aluminum electrolysis furnace arranged to be filled with a mass of electrolyte and having a plurality of anodes, a cathode composed of a plurality of carbon blocks all having the same electrical conductance, and means for introducing charges of aluminum oxide at a selected location of the furnace, the improvement comprising means for causing electric current flowing between said cathode and anodes to present a higher current density at such location than at a second location spaced from such location, said means comprising a layer of an electrically nonconductive material covering a portion of the surface of said cathode which faces said anodes in the region of such second location and which underlies the region to be occupied by the mass of electrolyte.

* * * * *